US006435178B1

(12) United States Patent
Lin

(10) Patent No.: US 6,435,178 B1
(45) Date of Patent: Aug. 20, 2002

(54) SWIM MASK WITH FLOATING AIR-SUCTION DEVICE

(76) Inventor: Cheng-Chi Lin, Room 3, 11th Floor, No. 19, Lane 751 Kang-Ning Street, Hsi-Chih City, Taipei Hsien (TW)

( * ) Notice: Subject to any disclaimer, the term of this patent is extended or adjusted under 35 U.S.C. 154(b) by 0 days.

(21) Appl. No.: 09/477,483

(22) Filed: Jan. 6, 2000

(51) Int. Cl.[7] ..... B63C 11/02

(52) U.S. Cl. ..... 128/201.27; 128/201.27; 128/201.28; 128/200.29

(58) Field of Search ..... 128/201.11, 201.26, 128/201.27, 201.28, 201.29, 200.29, 206.29; 405/186, 187

(56) References Cited

U.S. PATENT DOCUMENTS

| | | | | | |
|---|---|---|---|---|---|
| 908,690 | A | * | 1/1909 | Neubert | |
| 3,064,646 | A | * | 11/1962 | Miller | 128/145 |
| 3,370,586 | A | * | 2/1968 | Aragona et al. | 128/145 |
| 3,721,236 | A | * | 3/1973 | Bardehle | 128/145 A |
| 4,269,182 | A | * | 5/1981 | Le | 128/201.11 |
| 4,856,120 | A | * | 8/1989 | Hart | 2/428 |
| 5,524,611 | A | * | 6/1996 | Fu | 128/201.11 |
| 5,535,734 | A | * | 7/1996 | Lu et al. | 128/201.27 |
| 5,575,277 | A | * | 11/1996 | Lutz et al. | 128/201.18 |
| 5,606,967 | A | * | 3/1997 | Wang | 128/201.11 |
| 5,860,168 | A | * | 1/1999 | Winefordner et al. | 2/428 |
| 5,921,239 | A | * | 7/1999 | McCall et al. | 128/205.25 |
| 5,979,441 | A | * | 11/1999 | Hsieh | 128/201.28 |
| 6,119,693 | A | * | 9/2000 | Kwok et al. | 128/207.11 |

FOREIGN PATENT DOCUMENTS

| | | | |
|---|---|---|---|
| EP | 0340143 | * | 11/1989 |

* cited by examiner

*Primary Examiner*—John G. Weiss
*Assistant Examiner*—Mital Patel
(74) *Attorney, Agent, or Firm*—Rosenberg, Klein & Lee

(57) ABSTRACT

A swim mask apparatus having a mask equipped with a floating air-suction device is provided. The mask includes a plurality of straps extending from two lateral sides thereof to firmly attach the mask to a wearer's head and thereby provide watertight protection for the wearer's eyes and nose. The mask is provided with a one-way exhaust valve and a one-way sniffing valve. The floating air-suction device includes a float and an air hose extending therefrom. A terminal end of the air hose is connected to the one-way sniffing valve to form an inhalation airway between the float and the mask. The buoyancy of the float normally maintains the open end of the air hose coupled thereto above the water surface. When it is pulled sufficiently below the water surface by the air hose, the buoyant float is resistive to the displacement to the extent that compressing members formed therein constrictively engage the end of the air hose to prevent water from entering therethrough.

4 Claims, 6 Drawing Sheets

SWIM MASK WITH FLOATING AIR-SUCTION DEVICE

FIELD OF THE INVENTION

The present invention relates to a swim mask, and more particularly to a swim mask with a floating air-suction device so that a wearer, either an inexperienced or experienced swimmer or diver, is allowed to breathe normally during swimming, diving or any other water activities.

BACKGROUND OF THE INVENTION

Four-legged animals, such as dogs and cats, are inherent in swimming and would not be easily drowned. One of the reasons for this fact is these animals have a long neck that can always extend from the surface of water and protects the animals from choking with water. On the other hand, human beings have a short neck that is not long enough to always extend a swimmer's head from the water surface. For a person who does not swim, the risk of being drowned is therefore very high.

Even for a good swimmer, it is necessary to ventilate from time to time during swimming. That is, there are times the swimmer has to extend his or her head or at least the nose from the water for ventilation. It is impossible for the swimmer to easily stay below the water for a prolonged time. For fearing of drowning or choking with water, it is more difficult for people to learn swimming quickly and successfully.

There are also many accidents happened at dangerous riverside or beach, particularly in the summer, that are attributable to the lack of useful auxiliary equipment for safe swimming or diving in addition to the lack of law-abiding concept and necessary warm-up before swimming.

To swim within a safe waters may reduce but not eliminate the probability of tragedies of drowning. Even a good swimmer might be suddenly seized with a cramp and immediately in danger.

The currently available snorkel with mouthpiece is helpful in skin diving for extended time, but it is not suitable for general swimming. And such snorkel with mouthpiece has following disadvantages:

1. When a swimmer or diver holds the mouthpiece of the snorkel in the mouth, he or she has to breathe with mouth that is anyway not a normal breathing manner and would have adverse influence on our health.
2. The snorkel has limited length and is therefore not useful when diving deeply under water.
3. Breathing with mouth prevents the diver or swimmer from fully relaxing in the water. The user's mouth would soon become tired with holding the mouthpiece for a prolonged time.
4. The snorkel has not any means to prevent water from entering into it. Water tends to enter into the snorkel when diving or swimming at surgy sea.
5. The snorkel with mouthpiece does not help when an accident happens, such as a suddenly cramped leg or an exhausted swimmer or diver.

It is therefore tried by the inventor to develop a swim mask with floating air-suction device to eliminate possible dangers during swimming or diving.

SUMMARY OF THE INVENTION

A primary object of the present invention is to provide a swim mask with floating air-suction device, comprise a mask being provided at two lateral sides with at least one set of straps for firmly attaching said mask to a wearer's head to tightly cover the wearer's eyes and nose in a watertight manner to prevent external water from entering into said mask; and a floating air-suction device connected to said mask at a predetermined position, said floating air-suction device including an air hose having a first end connected to said mask and a second end associated with a float; said float normally floating said air hose so that an end opening of said second end of said air hose is always located above a surface of water; whereby when the wearer inhales simply in a normal breathing manner, external fresh air only is sucked via said second end of said air hose to supply to said mask.

The swim mask with floating air-suction device further comprises a one-way exhaust valve fixedly mounted on said mask at a predetermined position, said one-way exhaust valve including a first valve body defining a first hollow valve chamber therein, a first end of said first valve chamber being provided with a plurality of first through holes for communicating said first valve chamber with a space outside said mask, and a second end of said first valve chamber being provided with a plurality of second through holes for communicating said first valve chamber with a space inside said mask; and a first valve diaphragm being supported on a central valve stem provided in said first hollow valve chamber, such that said first valve diaphragm normally tightly covers and closes an inner side of said second through holes to prevent external water from entering into said mask via said second through holes; whereby when the wearer exhales via nose, air exhaled by the wearer pushes and bends an outer periphery of said first valve diaphragm toward said first end of said first valve chamber to open said second through holes, allowing exhaled air to pass said second through holes, said first hollow valve chamber, and said first through holes and into the space outside said mask.

The swim mask with floating air-suction device further comprises a one-way sniffing valve fixedly mounted on said mask at a predetermined position and connected to said first end of said air hose, said one-way sniffing valve including a second valve body defining a second hollow valve chamber therein, a first end of said second valve chamber being provided with a plurality of third through holes for communicating said second valve chamber with a space inside said mask, and a second end of said second valve chamber being provided with a plurality of fourth through holes for communicating said second valve chamber with said air hose; and a second valve diaphragm being supported on a central valve stem provided in said second hollow valve chamber, such that said second valve diaphragm normally tightly covers and closes an inner side of said fourth through holes to prevent air exhaled by the wearer from entering into said air hose via said fourth through holes; whereby when the wearer inhales via nose, external fresh air is continuously sucked into said air hose to push and bend an outer periphery of said second valve diaphragm toward said first end of said second valve chamber via said fourth through holes, allowing sucked air to enter into said second valve chamber via said fourth through holes and pass said third through holes into said mask, and when there is any water entering into and accumulated in said mask, the wearer may easily drain said accumulated water simply by breathing continuously in a normal manner.

The mask is provided at two lateral sides with an upper and a lower set of straps for firmly attaching said mask to the wearer's head.

Each set of straps includes a first and a second strap separately extended from two lateral sides of said mask, said first strap including a first elastic band portion, a first end of which being fixedly connected to one side of said mask and a second end of which being connected to, for example, a hook tape of a Magic Tape, and said second strap including a second elastic band portion, a first end of which being fixedly connected to another side of said mask opposite to said first strap and a second end of which being connected to, for example, a loop tape of a Magic Tape; whereby by firmly attaching said hook tape to said loop tape, said first strap and said second strap are connected to each other to tightly cover said mask on the wearer's face.

The air hose of said floating air-suction device is made of a soft and flexible material and has wedge-shaped projections provided on an outer periphery of said second end of said air hose with a thick side of said projections closer to an end opening of said second end; and wherein said float is provided at a bottom portion with an open-bottomed socket into which said second end of said air hose is extended, at one side of said float with at least one air inlet to communicate said socket with external air, and at two diametrically opposite points on a peripheral wall of said socket with compressing means that abut against the outer periphery of said second end of said air hose near a thin side of said wedge-shaped projections; whereby when said air hose is pulled downward relative to said float, said compressing means operatively press from two opposite directions against said wedge-shaped projections to finally seal said end opening of said second end of said air hose and prevent external water from entering into said air hose via said second end.

The compressing means are two rollers rotatably mounted at two diametrically opposite points on the periphery wall of said socket of said float to press against and roll over said wedge-shaped projections and finally seal said end opening of said second end of said air hose when said air hose is pulled downward relative to said float.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
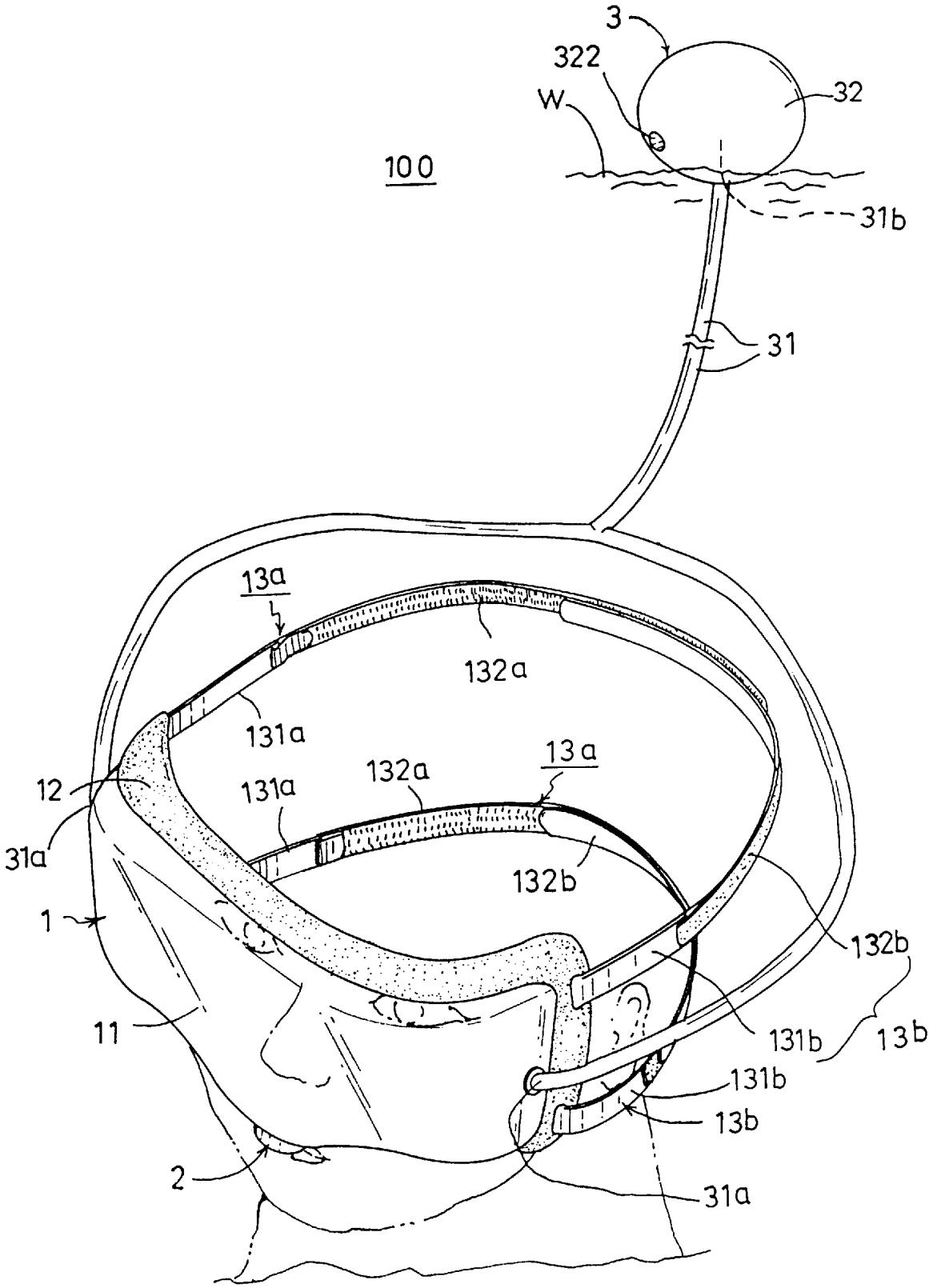
FIG. 1 is a perspective of the swim mask with floating air-suction device according to the present invention.

Referring to FIGS. 1 through 9, the present invention relates to a swim mask with a floating air-suction device, collectively referenced as apparatus 100. The apparatus 100 generally includes a mask 1, a one-way exhaust valve 2, a floating air-suction device 3, and at least a one-way sniffing valve 4. The mask 1 is provided at two lateral sides with at least one set of straps 13*a*, 13*b* for tightly fastening the mask 1 to a wearer's head to cover and protect the wearer's eyes and nose from water. The one-way exhaust valve 2 is fixedly mounted on the mask 1 for discharging air exhaled by the wearer. The floating air-suction device 3 has an air hose 31, a first end 31*a* of which is connected to the one-way sniffing valve 4 and a second end 31*b* of which is associated with a float 32, so that the second end 31*b* of the air hose 31 is normally brought by the float 32 to locate above a water surface. The one-way sniffing valve 4 is fixedly mounted on the mask 1 to connect to the first end 31*a* of the air hose 31. Air exhaled by the wearer could be discharged from inside of the mask 1 only through the one-way exhaust valve 2, and fresh air could be continuously supplied into the mask 1 only through the one-way sniffing valve 4. Therefore, good flow of air through the mask 1 is permitted. In the event of any leak in the mask 1, the wearer can remove any accumulated water in the mask 1 simply by breathing continuously. With the present invention, the wearer could draw external fresh air into the mask 1 via the air hose 31 simply by normal breathing with nose.

The mask 1 includes a lens 11, a skirt 12 made of rubber material and connected to an outer periphery of the lens 11 for contacting with the wearer's face in a watertight manner, and at least one set of straps 13*a*, 13*b* that are separately provided at two lateral sides of the mask 1 as mentioned earlier herein. The strap 13*a* includes an elastic band portion 131*a*, a first end of which is fixedly connected to one side of the skirt 12 and a second end of which is connected to, for example, a hook tape portion 132*a* of a MAGIC TAPE hook and loop fastening material. The strap 13*b* includes an elastic band portion 131*b*, a first end of which is fixedly connected to another side of the skirt 12 tape portion 132*b* of a MAGIC TAPE hook and loop fastening material. By firmly attaching the hook tape portion 132*a* to the loop tape portion 132*b*, the straps 13*a* and 13*b* are connected to each other to tightly cover the mask 1 on the wearer's face.

The mask 1 illustrated in FIG. 1 is provided with an upper and a lower set of straps 13*a*, 13*b* to ensure fit and tight covering of the mask 1 to the wearer's face and prevent water from easily entering into the mask 1. However, it is noted that the numbers and types of the straps can be changed without limitation, so long as the straps are suitable for fastening the mask 1 to the wearer's head.

Figure 2:
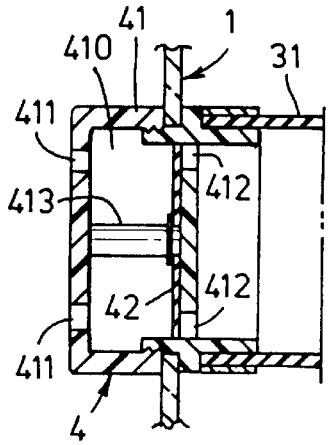
FIG. 2 is a fragmentary sectional view of the swim mask of FIG. 1.
Figure 4:
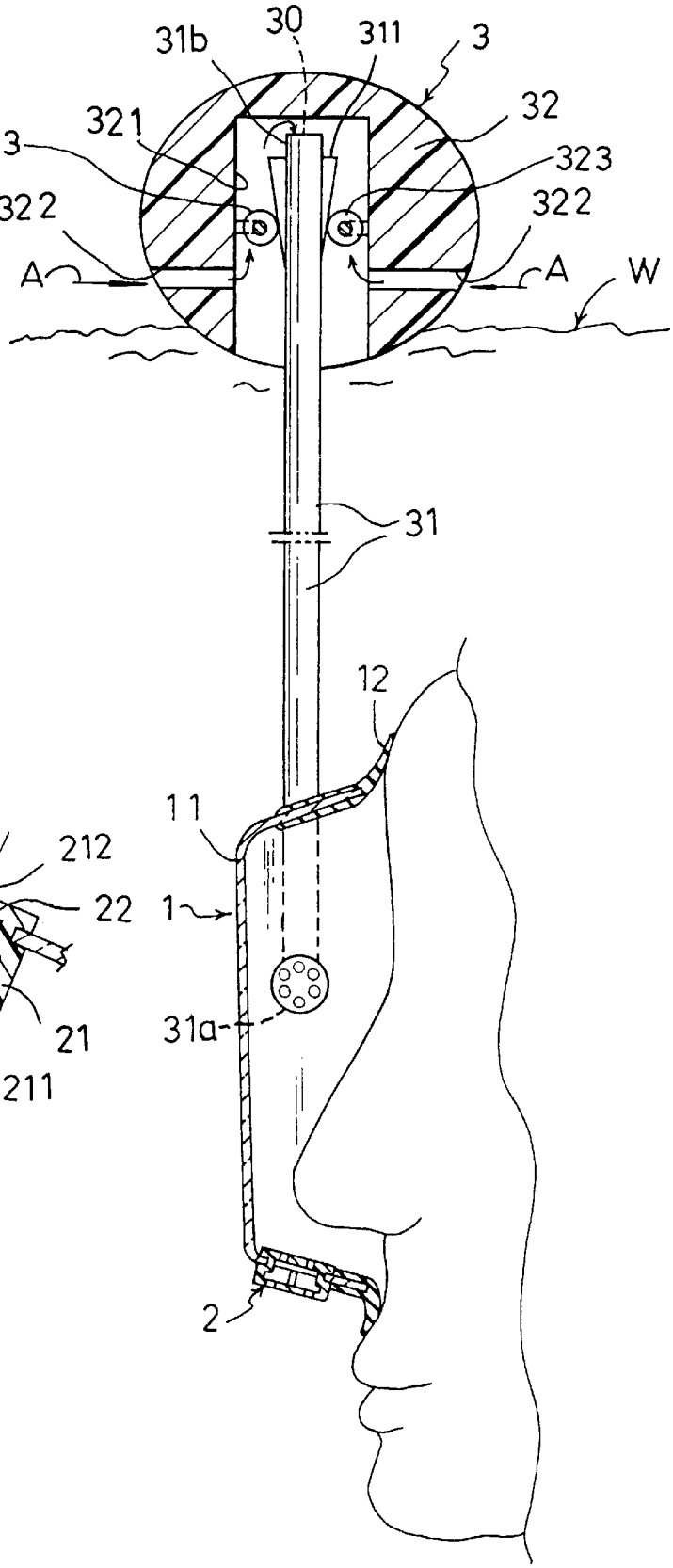
FIG. 4 is a sectional view showing the structure a one-way exhaust valve included in the present invention.

Please refer to FIGS. 2 and 4. The one-way exhaust valve 2 is mounted on the mask 1 at a position below the wearer's nose and mainly includes a valve body 21 that defines a hollow chamber 210 therein. A first end of the valve chamber 210 is located outside the mask 1 and provided with a plurality of through holes 211 and a second end of the valve chamber 210 is located inside the mask 1 and provided with a plurality of through holes 212 to communicate the valve chamber 210 with an inner side of the mask 1. A valve diaphragm 22 is supported on a central valve stem 213 provided in the valve chamber 210, such that the valve diaphragm 22 normally attaches to an inner side of the second end of the valve chamber 210 and tightly closes the through holes 212. When the wearer exhales, an air pressure of the inner side of the mask 1 increases to push and bend an outer periphery of the valve diaphragm 22 toward the first end of the valve chamber 210, as shown by the phantom line in FIG. 4, and therefore open the through holes 212. Air exhaled by the wearer into the mask 1 passes the through holes 212 into the valve chamber 210 and then exhausts from the through holes 211 at the first end of the valve chamber 210. And, when the wearer inhales, the valve diaphragm 22 elastically restores and is sucked to tightly cover and close the through holes 212 again, effectively preventing water outside the mask 1 from entering into the mask 1 via the through holes 212.

Figure 3:
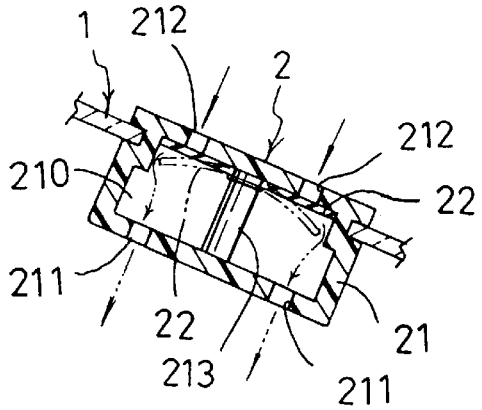
FIG. 3 is a sectional view showing the structure a one-way sniffing valve included in the present invention.

Please now refer to FIGS. 2 and 3. The one-way sniffing valve 4 is mounted on the mask 1 and connected to the first end 31*a* of the air hose 31. As mentioned above, air exhaled by the wearer could be discharged from inner side of the mask 1 only through the one-way exhaust valve 2 and fresh air could be continuously supplied into the mask 1 only through the one-way sniffing valve 4. Therefore, good flow of air through the mask 1 is permitted. In the event of any leak in the mask 1, the wearer can remove any accumulated water in the mask 1 simply by breathing continuously. The one-way sniffing valve 4 includes a valve body 41 that defines a hollow chamber 410 therein. A first end of the valve chamber 410 is located inside the mask 1 and provided with a plurality of through holes 411 and a second end of the valve chamber 410 is located outside the mask 1 to connect to the first end 31*a* of the air hose 31. The second end of the valve chamber 410 is provided with a plurality of through holes 412 to communicate the air hose 31 with an inner side of the mask 1. A valve diaphragm 42 is supported on a central valve stem 413 provided in the valve chamber 410, such that the valve diaphragm 42 normally attaches to an inner side of the second end of the valve chamber 410 and tightly closes the through holes 412, preventing air exhaled by the wearer into the mask 1 from entering into the air hose 31 via the through holes 412. That is, the exhaled air could only be discharged from the mask 1 via the one-way exhaust valve 2. When the wearer inhales, an air pressure of the inner side of the mask 1 decreases to suck and bend an outer periphery of the valve diaphragm 42 toward the first end of the valve chamber 410 and therefore open the through holes 412. At this point, external fresh air is sucked to sequentially pass the air hose 31, through holes 412, the hollow valve chamber 410, through holes 411 and enter into the mask 1. And, when the wearer exhales, the valve diaphragm 42 elastically restores to tightly cover and close the through holes 412 again. The exhaled air inside the mask 1 could not enter into the air hose 31 via the through holes 412 but exhausts from the mask 1 via the one-way exhaust valve 2.

Figure 5:
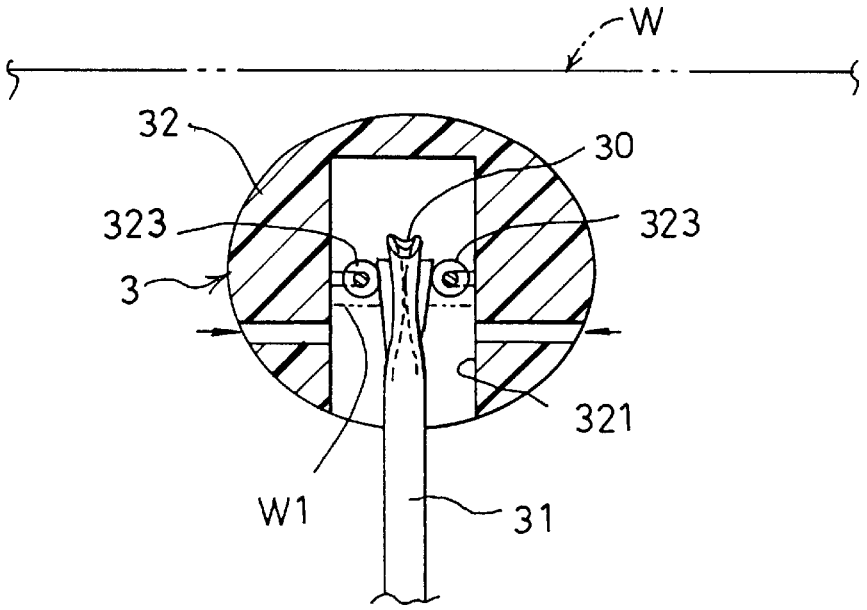
FIG. 5 is a fragmentary sectional view showing the floating air-suction device that is located completely below a water surface.

Please refer to FIGS. 2, 3 and 5. The floating air-suction device 3 includes an air hose 31 and a float 32. The air hose 31 is made of a soft and flexible material, a first end 31*a* of which is connected to the one-way sniffing valve 4 mounted on the mask 1 and a second end 31*b* of which is associated with the float 32 and has wedge-shaped projections 311 provided on an outer periphery thereof with a thick side of the projections closer to the second end 31*b*. The float 32 is formed at a bottom portion with an open-bottomed socket 321 into which the second end 31*b* of the air hose 31 is extended. At least one air inlet 322 is provided at one side of the float 32 to communicate the socket 321 with external air. Compressing means 323 are provided at two diametrically opposite points on a peripheral wall of the socket 321 to abut against the outer periphery of the second end 31*b* of the air hose 31 near a thin side of the wedge-shaped projections 311, such that when the air hose 31 is pulled downward relative to the float 32, the compressing means 323 operatively press from two opposite directions against the wedge-shaped projections 311 to finally seal an end opening 30 at the second end 31*b* of the air hose 31, as shown in FIG. 5, preventing external water from entering into the air hose 31 via the second end 31*b*.

As can be seen from FIGS. 1 and 6 to 9, the float 32 of the floating air-suction device 3 always automatically floats the air hose 31 so that the end opening 30 of the second ends 31*b* of the air hose 31 is always located above the surface W of water, no matter how the wearer moves in water. When the wearer breathes in a normal manner, external fresh air A is sucked to flow via the at least one air inlet 322 on the float 32 and the air hose 31 into the mask 1. When the float 32 is floating on the surface W of water, the air inlet 322 is at a position horizontally lower than the end opening 30 of the second end 31*b* of the air hose 31. In the event there is water entering into the float 32 via the air inlet 322 when the float 32 is floating on the water surface W, the water will naturally flow down into the open-bottomed socket 321 without entering into the air hose 31 via the end opening 30 thereof to choke the wearer.

Figure 6:
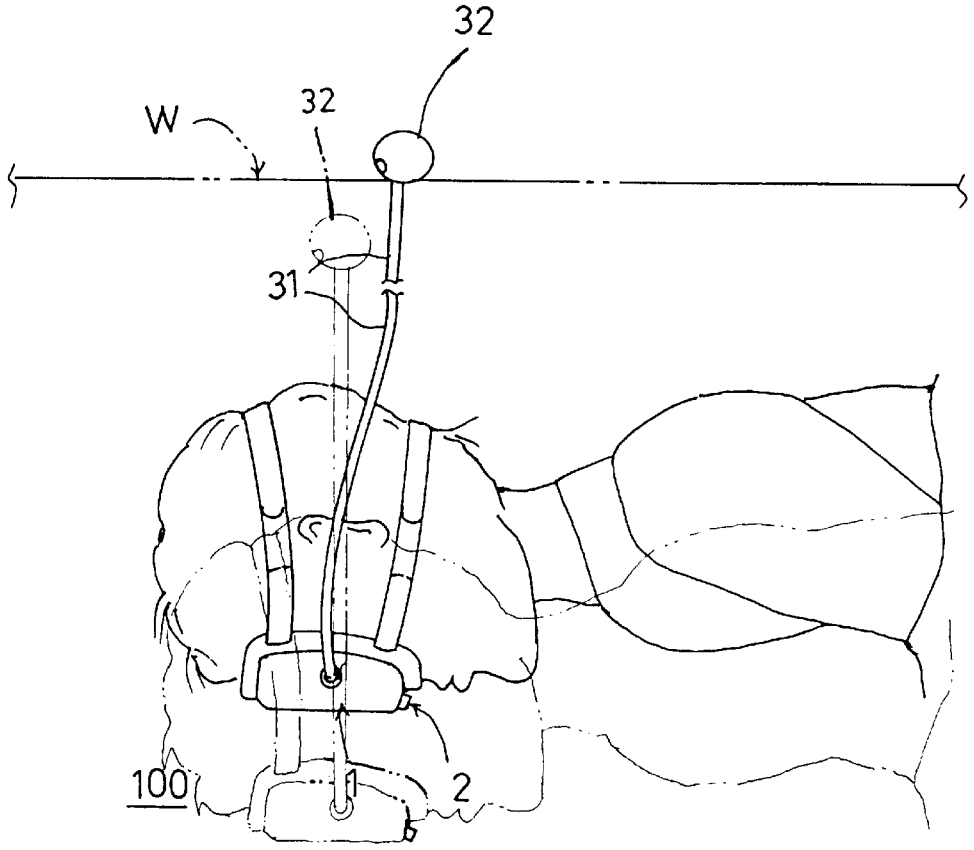
FIG. 6 schematically shows the swim mask of the present invention being used at diving.
Figure 7:
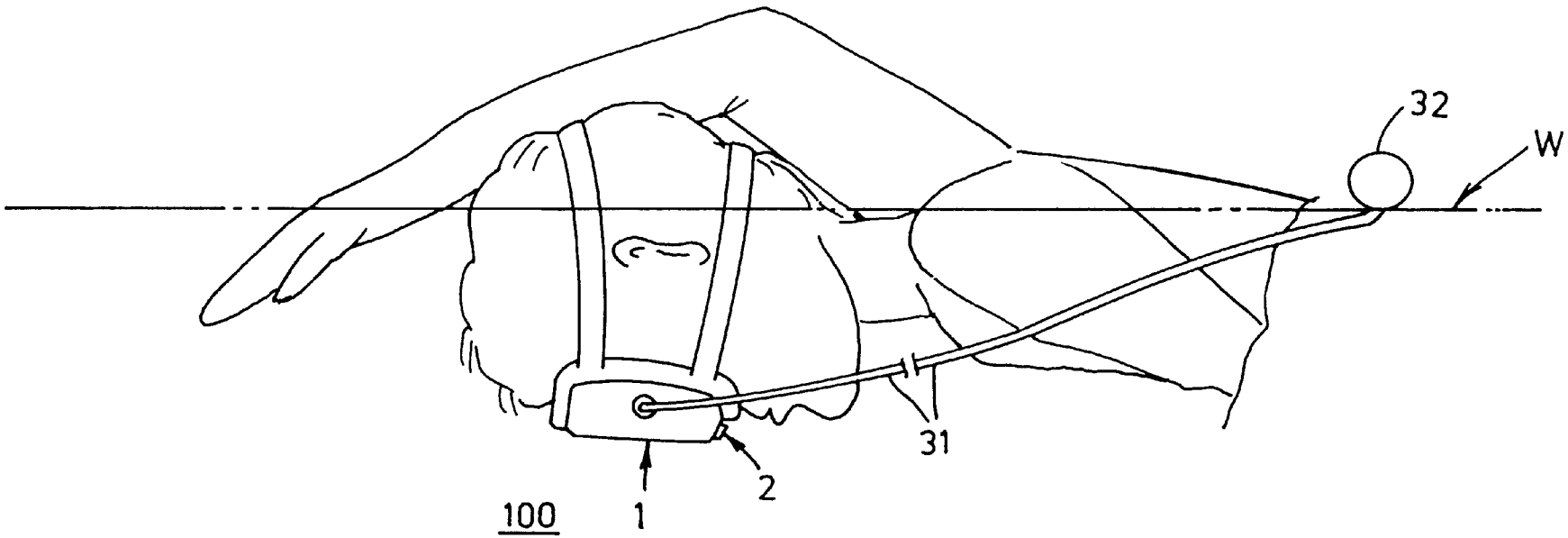
FIG. 7 schematically shows the swim mask of the present invention being worn by a swimmer swimming in breast stroke.
Figure 8:
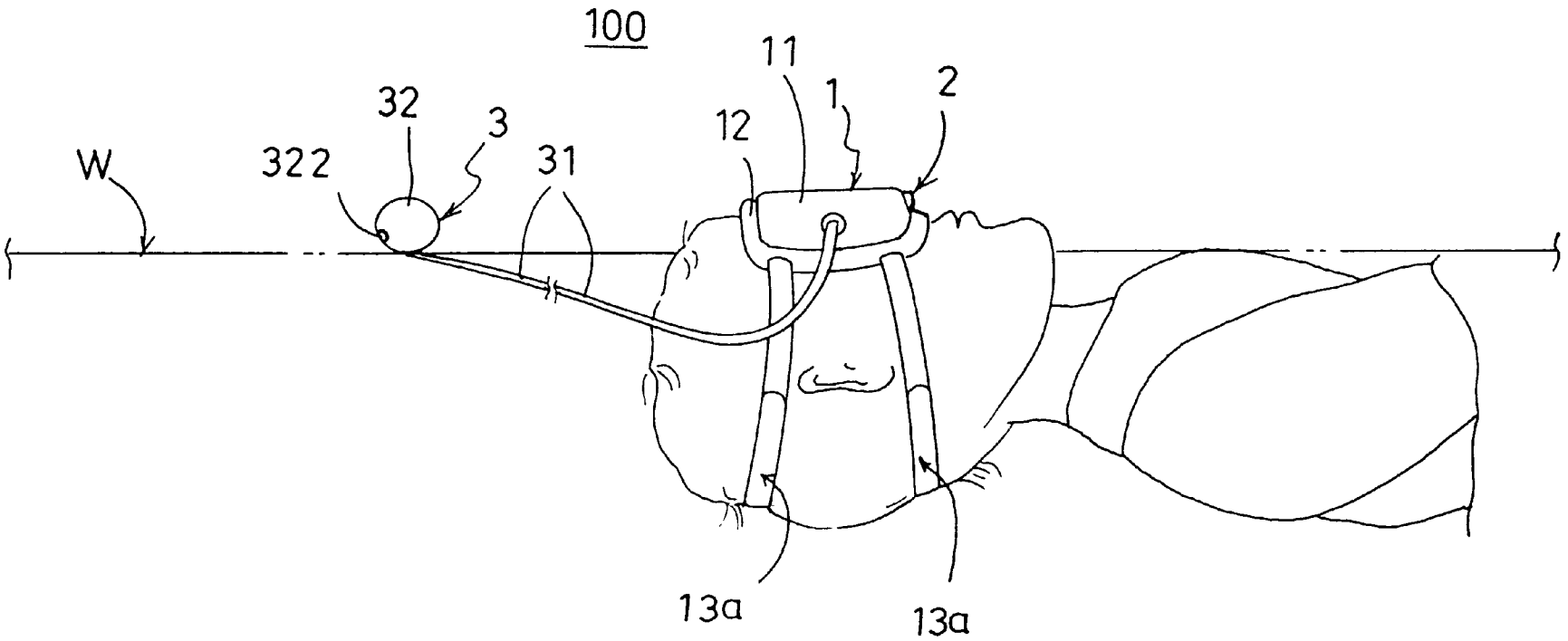
FIG. 8 schematically shows the swim mask of the present invention being worn by a swimmer swimming in backstroke.
Figure 9:
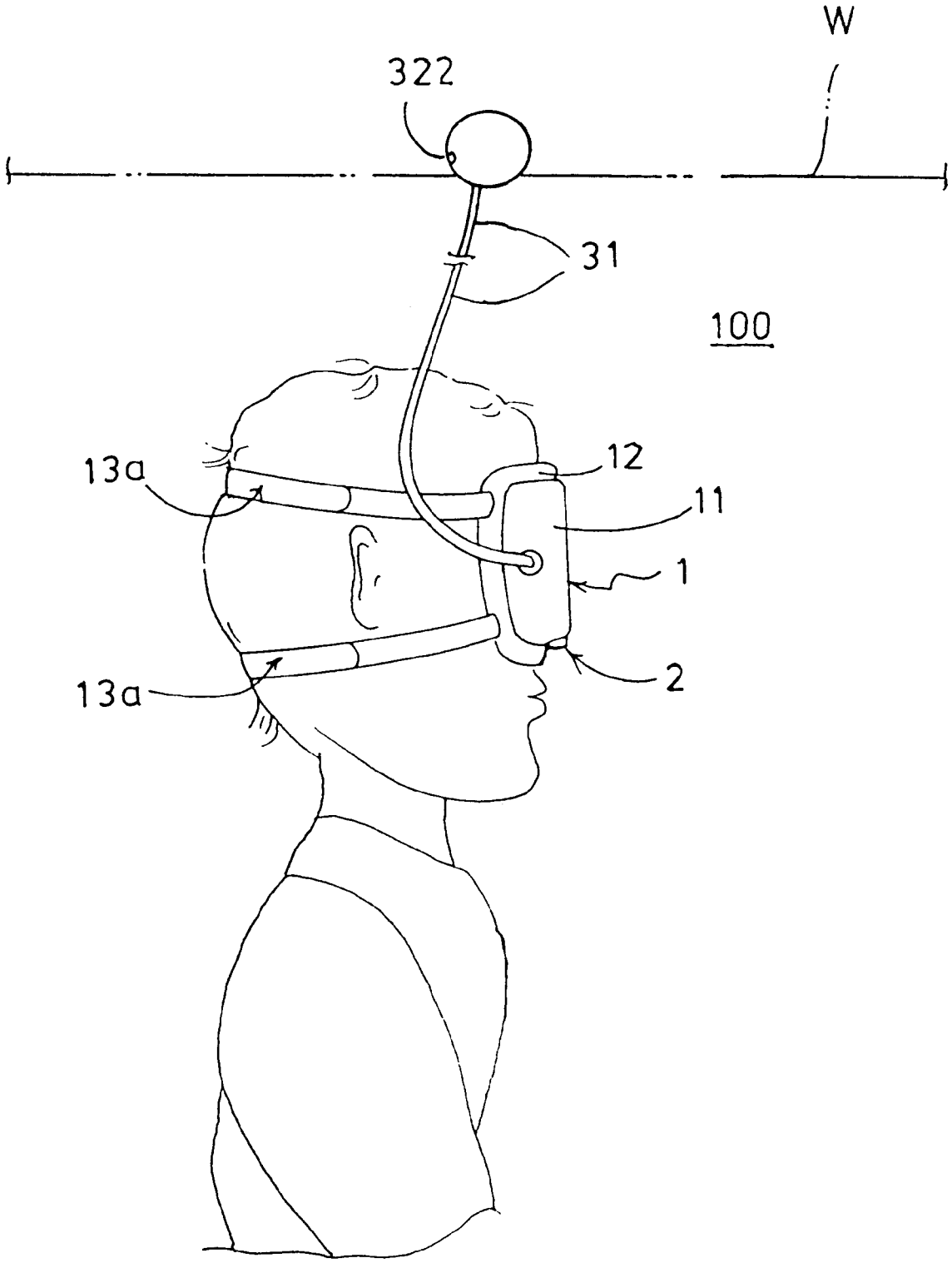
FIG. 9 schematically shows the swim mask of the present invention being worn by a swimming beginner walking below the water surface.

When the wearer dives in the water and pulls the float 32 down below the water surface W, as shown in FIG. 6, a buoyancy of the float 32 would cause the compressing means 323 in the socket 321 of the float 32 to locate higher relative to the air hose 31 and therefore presses against the wedge-shaped projections 311 at the second end 31*b* of the air hose 31 and finally seals the end opening 30 of the air hose 31, as shown in FIG. 5, preventing external water from entering into the air hose 31 via the end opening 30. When the end opening 30 of the air hose 31 is sealed, a top space in the socket 321 above the compressing means 323 and the sealed air hose 31 forms a closed pressure zone that effectively stops water from fully filling the socket 321. That is, a water level W1 in the socket 321 is constantly lower than the end opening 30 of the second end 31*b* of the air hose 31. On the other hand, when the wearer swims from deep down the water to somewhere near the water surface W, the float 32 automatically floats on the water and brings the air hose 31 to move upward with the end opening 30 of the air hose 31 located higher in the socket 321 relative to the float 32. At this point, the compressing means 323 no longer press against the wedge-shaped projections 311 on the second end 31*b* of the air hose 31 to open the end opening 30 again, allowing the wearer to breathe normally.

In the floating air-suction device 3 illustrated in the accompanying drawings, the compressing means 323 mounted in the socket 321 of the float 32 are two rollers rotatably mounted on the peripheral wall of the socket 321 at two diametrically opposite points. When the air hose 31 is pulled downward when the wearer dives, the rollers 323 roll and get in contact with the thick side of the wedge-shaped projections 311 to press them from two opposite directions and finally seal the end opening 30 of the air hose 31.

With the above arrangements, the swim mask 100 with floating air-suction device of the present invention allows a wearer to normally breathe with nose during swimming or diving. The following is a summary of the advantages of the present invention:

1. A user wearing the swim mask 100 of the present invention, having his or her nose either above or below the water surface W, could easily breathe in a natural and normal manner to inhale fresh air from above the water surface without the risk of sniffing in water and choking or even drowning.

2. The swim mask 100 of the present invention allows all types of different wearers, such as a swim beginner, a skilled swimmer, a diver or even a person who does not swim, to very safely and comfortably swim in different styles, such as breast stroke or backstroke, dive, walk in water, relaxedly float on water or do other water activities.
3. The swim mask 100 of the present invention effectively protects all types of different wearers, such as a swim beginner, a skilled swimmer, a diver or even a person who does not swim, against the dangers of drowning during all kinds of water activities, either above or under water.
4. The swim mask 100 of the present invention absolutely stops water from entering into the mask 1 and allows all wearers to breathe normally and comfortably while completely relaxedly floating on water or diving under water. The swim mask 100 of the present invention can therefore be used as an excellent water therapy.
5. The swim mask 100 of the present invention is suitable for use in all types of swimming or diving styles.
6. The swim mask 100 of the present invention effectively protects a wearer against choking with water or drowning and is therefore particularly suitable for a swimming beginner.
7. The wearer of the swim mask 100 of the present invention need not ventilate above water and can therefore swim at increased speed.
8. The swim mask 100 of the present invention would automatically enter into a sealed state to prevent water from flowing into the air hose 31 when the floating air-suction device 3 thereof is pulled down below the water surface W.
9. The specially designed one-way exhaust valve 2 and one-way sniffing valve 4 for the swim mask 100 of the present invention allows air exhaled by the wearer to successfully discharge only through the one-way exhaust valve 2, and external fresh air to continuously supply into the mask 1 only via the one-way sniffing valve 4 when the wearer breaths in a normal and natural manner. Good air flowing in the mask 1 can be achieved.
10. In the event of any water flowing into and accumulated in the mask 1, the specially designed one-way exhaust valve 2 and one-way sniffing valve 4 for the swim mask 100 of the present invention allows the wearer to easily drain the accumulated water simply through continuous breathing.

The present invention has been described in an illustrative manner, and it is to be understood that the structure, shape, etc. described herein are not intended to be limitations of the present invention. Many modifications and variations of the present invention are possible in light of the above teachings. For example, the one-way exhaust valve 2 may be omitted and the wearer may inhale via nose and exhale via mouth without adversely affecting the function of the present invention. Therefore, it is to be understood that within the scope of the appended claims, the invention may be practiced otherwise than as specifically described.

What is claimed is:

1. A swim mask with floating air-suction device, comprising:

a mask provided at two lateral sides with at least one set of straps for firmly attaching said mask to a wearer's head to tightly cover the wearer's eyes and nose in a watertight manner to prevent external water from entering into said mask;

a floating air-suction device connected to said mask at a predetermined position, said floating air-suction device including an air hose having a first end connected to said mask and a second end associated with a float; said float normally floating said air hose so that an end opening of said second end of said air hose is always located above a surface of water; whereby when the wearer inhales simply in a normal breathing manner, external fresh air only is sucked via said second end of said air hose to supply to said mask;

a one-way exhaust valve fixedly mounted on said mask at a predetermined position, said one-way exhaust valve including a first valve body defining a first hollow valve chamber therein, a first end of said first valve chamber being provided with a plurality of first through holes for communicating said first valve chamber with a space outside said mask, and a second end of said first valve chamber being provided with a plurality of second through holes for communicating said first valve chamber with a space inside said mask; and a first valve diaphragm being supported on a central valve stem provided in said first hollow valve chamber, such that said first valve diaphragm normally tightly covers and closes an inner side of said second through holes to prevent external water from entering into said mask via said second through holes; whereby when the wearer exhales via nose, air exhaled by the wearer pushes and bends an outer periphery of said first valve diaphragm toward said first end of said first valve chamber to open said second through holes, allowing exhaled air to pass said second through holes, said first hollow valve chamber, and said first through holes and into the space outside said mask; and, a one-way sniffing valve fixedly mounted on said mask at a predetermined position and connected to said first end of said air hose, said one-way sniffing valve including a second valve body defining a second hollow valve chamber therein, a first end of said second valve chamber being provided with a plurality of third through holes for communicating said second valve chamber with a space inside said mask, and a second end of said second valve chamber being provided with a plurality of fourth through holes for communicating said second valve chamber with said air hose; and a second valve diaphragm being supported on a central valve stem provided in said second hollow valve chamber, such that said second valve diaphragm normally tightly covers and closes an inner side of said fourth through holes to prevent air exhaled by the wearer from entering into said air hose via said fourth through holes; whereby when the wearer inhales via nose, external fresh air is continuously sucked into said air hose to push and bend an outer periphery of said second valve diaphragm toward said first end of said second valve chamber via said fourth through holes, allowing sucked air to enter into said second valve chamber via said fourth through holes and pass said third through holes into said mask, and when there is any water entering into and accumulated in said mask, the wearer may easily drain the accumulated water simply by breathing continuously in a normal manner.

2. A swim mask with floating air-suction device comprising:

a mask being provided at two lateral sides with at least one set of straps for firmly attaching said mask to a wearer's head to tightly cover the wearer's eyes and nose in a watertight manner to prevent external water from entering into said mask;

a floating air-suction device connected to said mask at a predetermined position, said floating air-suction device including an air hose having a first end connected to said mask and a second end associated with a float; said float normally floating said air hose so that an end opening of said second end of said air hose is always located above a surface of water; whereby when the wearer inhales simply in a normal breathing manner, external fresh air only is sucked via said second end of said air hose to supply to said mask;

said air hose of said floating air-suction device being made of a soft and flexible material and having wedge-shaped projections provided on an outer periphery of said second end of said air hose with a thick side of said projections closer to an end opening of said second end; said float being provided at a bottom portion with an open-bottomed socket into which said second end of said air hose is extended, one side of said float being formed with at least one air inlet to communicate said socket with external air, and two diametrically opposite points on a peripheral wall of said socket being formed with compressing means that abut against the outer periphery of said second end of said air hose near a thin side of said wedge-shaped projections; whereby when said air hose is pulled downward relative to said float, said compressing means operatively press from two opposite directions against said wedge-shaped projections to constrict said end opening of said second end of said air hose and prevent external water from entering into said air hose via said second end.

3. A swim mask with floating air-suction device as claimed in claim 2, wherein said compressing means are two rollers rotatably mounted at two diametrically opposite points on the periphery wall of said socket of said float to press against and roll over said wedge-shaped projections and finally seal said end opening of said second end of said air hose when said air hose is pulled downward relative to said float.

4. A respiratory swim mask apparatus comprising:

(a) a mask having a plurality of straps for firmly attaching to a wearer's head and covering in substantially water-tight manner the eyes and nose of a user to thereby define a protective compartment thereabout;

(b) a buoyant float having formed therein a bottom opening and a socket bore extending upward therefrom, said float having formed therein at least one air inlet passage extending transversely from and in open communication with said socket bore; and, (c) an air hose coupled to extend between said mask and said float, said air hose having a first end secured to said mask for communication with said protective compartment defined by said mask and a second end adjustably coupled to said float for selective communication with said socket bore responsive to the position of said float relative to a water surface, said second end of said air hose being alternatively maintained in an open state when said air inlet passage of said float is disposed above the water surface, and in a constricted state when said air inlet passage of said float is at least partially disposed below the water surface.

* * * * *